United States Patent [19]

Laugs et al.

[11] Patent Number: 4,690,718

[45] Date of Patent: Sep. 1, 1987

[54] APPARATUS FOR AND METHOD OF MAKING THE CABLE CORE OF A TELECOMMUNICATION CABLE WATER-TIGHT IN THE LONGITUDINAL DIRECTION

[75] Inventors: Johannis A. B. Laugs, Gouda; Gerrit Van Den Berg, Vlaardingen; Peter A. Van Daalen, Bleiswijk; Edward D. Reinders, Boskoop, all of Netherlands

[73] Assignee: N.K.F. Groep B.V., Rijswijk, Netherlands

[21] Appl. No.: 799,212

[22] Filed: Nov. 18, 1985

[30] Foreign Application Priority Data

Nov. 19, 1984 [NL] Netherlands ..... 8403514

[51] Int. Cl.[4] ..... H01B 13/14

[52] U.S. Cl. ..... 156/48; 156/244.12; 156/500; 174/23 C; 174/23 R; 264/272.14; 425/382 R; 427/120

[58] Field of Search ..... 156/48, 244.12, 500; 174/23 C, 23 R; 264/272.14; 425/113, 382 R; 427/120

[56] References Cited

U.S. PATENT DOCUMENTS

| | | | |
|---|---|---|---|
| 3,671,622 | 6/1972 | Humphries | 264/263 |
| 3,767,454 | 10/1973 | Franke et al. | 156/48 X |
| 3,789,099 | 1/1974 | Garrett et al. | 156/48 X |
| 3,876,487 | 4/1975 | Garrett et al. | 156/48 X |
| 4,106,961 | 8/1978 | Kreuger et al. | 156/48 |
| 4,164,617 | 8/1979 | Van Kesteren | 174/23 C |
| 4,451,692 | 5/1984 | Classens et al. | 156/48 X |
| 4,568,400 | 2/1986 | Patterson et al. | 156/48 |

*Primary Examiner*—Robert A. Dawson

*Attorney, Agent, or Firm*—Cushman, Darby & Cushman

[57] ABSTRACT

A method of and apparatus for making the cable core of a telecommunication cable water-tight in the longitudinal direction, in which a filling material having a base of petroleum jelly is heated to a temperature above the drop point, is supplied under pressure to a filling head (5), is divided into a number of jets distributed over the circumference of the cable core, is passed through the filling head (5) with simultaneous conversion of the static pressure into kinetic energy and is injected through the outer layer of the cable core into the heart of the cable core, in which a reconversion of the kinetic energy into static pressure is effected and all the interstices and gaps between the single wires of the cable core are filled with the filling material.

10 Claims, 7 Drawing Figures

APPARATUS FOR AND METHOD OF MAKING THE CABLE CORE OF A TELECOMMUNICATION CABLE WATER-TIGHT IN THE LONGITUDINAL DIRECTION

BACKGROUND OF THE INVENTION

The invention relates to a method of making the cable core of a telecommunication cable water-tight in the longitudinal direction, in which the cable core consisting of stranded single wires is passed through a filling head, a filling material mainly consisting of hydrocarbons is supplied under pressure and in an excess quantity to the filling head at a temperature above the pour point of the material, is spread over the circumference of the cable core and is introduced into the cable core and the excess of filling material not absorbed by the cable core is drained away.

Telecommunication cables, which are generally buried in earth, must be protected as much as possible from the permeation of moisture and water into the cable and more particularly from the further penetration of water in the longitudinal direction of the cable. In cables whose single wires are provided with a paper insulation the paper also serves as a barrier against the penetration of water because the paper sheaths of the separate single wires will swell due to wetting and, apart from the moisture absorbed by the paper, form a practically adequate seal against a further penetration of water.

However, now the use of single wires with plastic insulation has become common practice, the problem of telecommunication cables being damaged by permeation of moisture and water has become very serious. Due to the fact that plastic material does not swell due to wetting, moisture and water, once permeated into the cable, can penetrate without hindrance along the single wires in the longitudinal direction of the cable. If such a penetration of moisture and water is not prevented, the electrical properties of the cable, such as capacitance and cross-talk, can deteriorate as a whole considerably. Furthermore, the water which has penetrated the cable can attack the single wires electrolytically through pin holes in the insulation and can lead to corrosion. Moreover, there is a risk of the water penetrating into the joint boxes, which may lead to short-circuits between the individual transmission circuits.

Various methods of making telecommunication cables longitudinally water-tight are known. According to one of these methods, a filling material having a base of petroleum jelly that may be mixed with polyethylene, is introduced into the cable core. This is effected at a temperature above the pour point of the filling material.

Such a filling material has a consistency such that a higher temperature of the order of 80° C. it has a low dynamic viscosity of about 0.046 Pa.s and at a lower temperature of about 50° C. it has a higher viscosity of about 9.15 Pa.s.

A method in which such a filling material with a petroleum jelly base is introduced into the cable core of a telecommunication cable is known from U.S. Pat. Nos. 3,789,099 and 3,876,487. In this known method, the heated filling material is supplied under pressure and in an excess quantity to the pressure filling chamber of a filling head, a pressure gradient being produced between the pressure filling chamber and a pressure relief chamber in order to obtain an axial flow of the filling material and to drain away the excess quantity of filling material supplied. This known method is based on a combination of pressure and speed of the filling material. Since the cable core in the pressure filling chamber is subjected to pressure on all sides, it is slightly pinched, as a result of which the penetration of filling material is impeded. In view of the pressure in the pressure filling chamber, this chamber has to be sealed, which gives rise to many problems. If the seals are seals which have a tight fit, there is a risk of the cable core being compressed and, in some cases, being damaged, which results in a poor filling of the cable core. If the seals are seals having an ample fit, there is a risk that insufficient pressure is built up in the pressure filling chamber to press the filling material into the cable core. This also leads to a poorly filled cable core. Moreover, the seals, which are of course adapted to the diameter of the cable core to be treated, must be replaceable in order that cable cores having different dimensions can be treated on the same apparatus.

British Patent Specification No. 1,502,375 discloses a method and an apparatus in which the last-mentioned disadvantage is obviated by the use of flexible expansble sleeves as seals. However, the further aforementioned disadvantages, i.e. pinching of the cable core, damage of the cable core and insufficient build-up of pressure in the pressure filling chamber, remain. The aforementioned problems arise to a greater extent during the step of filling multiwire cable cores, i.e. cable cores comprising a relatively large number of single wires.

SUMMARY OF THE INVENTION

A principal object of the invention is to provide a method which does not exhibit these disadvantages and which especially permits of makaing the cable core longitudinally water-tight in a reliable and reproducible manner. According to the invention, this object is achieved mainly by dividing the filling material into a number of free jets distributed over the circumference of the cable core so that a substantially complete conversion of the static pressure into dynamic pressure of the filling material is obtained and the filling material is injected at a high speed solely in purely radial directions and without generation of an axial speed component through the outer layer of the cable core at least into the heart of the cable core in a manner such that a reconversion of the dynamic pressure into static pressure is effected in the cable core.

With this method the filling material is not pressed but is injected into the cable core. The static pressure of the filling material is converted substantially completely into dynamic pressure, except inevitable losses, such as conversion losses, frictional losses and the like, which are converted into heat according to the formula of Bernouilli:

$$p_t = p_{st} + \tfrac{1}{2}\rho v^2(1+\xi),$$

where $p_t$ = overall pressure in Pa $p_{st}$ = static pressure in Pa $v$ = speed m/s $\rho$ = density kg/m$^3$ while $\xi$ is the loss factor.

The term $\frac{1}{2}\rho v^2$ represents the dynamic pressure. Due to the fact that the filling material is not subjected to static pressure and no static pressure is built up, a pressure chamber with seals is not necessary and as a result the cable core is not pinched. Due to the high dynamic pressure, in other words the high kinetic energy of the filling material, the separate stranded single wires of the cores are pushed apart and openings are formed so that a large penetration depth and a good spread of the filling material as well as a complete and homogeneous filling of the cable core are obtained. When the heated filling material is supplied in an excess quantity and is injected at a high speed, such a large heat supply is obtained that the solidification front is shifted onto at least as far as into the heart of the cable core and no solidification takes place at all in the radial planes of the jets. Owing to the said heat supply, the homogeneity and the quality of the filling are influenced positively. On the other hand, once the filling material has been introduced into the cable core a comparatively rapid solidification is effected, which results in a comparatively short cooling trajectory so that, immediately after the step of making the cable core longitudinally water-tight, any foils that may be required and a plastics sheath can be applied to the cable core without the risk of the filling material leaking out of the cable core. It should be noted that the thermal effects described are obtained without a separate pre-treatment and after-treatment, respectively, of the cable core, especially heating and cooling.

Experiments have shown that, more particularly for filling multi-wire cable cores, the filling material has to be supplied in an excess quantity at least equal to ten times the quantity of filling material absorbed by the cable core. Dependent upon the cable type and the number of single wires, this excess quantity may be increased to sixty to seventy times.

By means of the method according to the invention, a complete series of cables of different types can be made longitudinally water-tight in a reproducible, reliable and economical manner.

The method has proved particularly suitable for filling in a single processing step multi-wire cable cores, i.e. cable cores comprising 4800 single wires and even more.

The steps of dividing the filling material into separate jets and converting the static pressure into dynamic pressure could take place upstream of the filling head between the filling head and the pump required for supplying the filling material. The filling material could then be supplied, for example, through pipes and be injected into the cable core. However, a preferred embodiment of the method according to the invention is characterized in that the steps of converting the static pressure into dynamic pressure and of dividing the filling material into a number of jets take place in the filling head.

When the conversion of static pressure into dynamic pressure takes place in the filling head, the filling material can be injected directly into the cable core substantially without conversion losses. It has been found that a limited number of jets (about 4 to 8) is sufficient to fill completely a cable core, including wire cable cores. However, the number of jets is not limited at all.

Due to the fact that in another preferred embodiment of the method according to the invention the filling material is divided into a single series of jets, the reliability and the reproducibility of the filling process are influenced positively. If the filling material is divided into several series of jets, the jets of the various successive series coul influence each other and the homogeneity of the filling coul be disturbed.

The jets may be directed, for example, in the same radial plane. However, in a further preferred embodiment of the method according to the invention, the separate jets are offset relative to one another in the longitudinal direction of the cable core. This measure avoids the single wires being pressed together by the jets and the step of filling the cable core being impeded.

In a still further preferred embodiment of the method according to the invention, in a further additional processing step, filling material is applied to the outer surface of the cable core at a temperature below the pour point and in an excess quantity. This additional step serves to supply the outer circumference of the cable core with a coating layer of the filling material before, in a further processing step. another wrapped or folded layer of material, for example, paper, plastics or metal, is applied to the cable core. Of course, since the filling material need not be injected at high speed into the cable core in this additional processing step, it is applied to the cable core at a comparatively low pressure.

A telecommunication cable, whose cable core has been made longitudinally water-tight by means of the method according to the invention is characterized by a homogeneous filling of the cable core to the heart of the core, even with multi-wire cables comprising 2400 and more pairs of wires.

The invention further relates to an apparatus for carrying out the method, comprising a container for a filling material, a filling head for supplying filling material into the core of the care, a pump for supplying filling material to the filling head and heating means for heating the filling material, the filling head comprising an annular pressure chamber through which the cable passes and a central passage chamber, the pressure chamber being connected to the pump and being in communication with the passage chamber through a series of orifices in a separation wall. According to the invention, this apparatus is characterized in that the pasage chamber extends without any restriction from one end to the other end of the filling head, is open at both ends and is in free communication.

The passage chamber is not pressurized, therefore need not be sealed and consequently can have large dimensions so that the cable core to be treated can pass through the filling head without any contact on the surfaces thereof. As a result, pressure relief chambers are not required. In view of the absence of sealing elements susceptible to wear and sensitive to disturbances, such as sealing dies and sealing sleeves, and in view of the large passage of the passage chamber, no components need be replaced when the arrangement is changed over for other cable types within a given range of diameters.

When changing over for cable types of a different range of diameters it is sufficient to exchange the component comprising the separation wall with the passage chamber.

Furthermore, as already stated above, no pre- or after-treatment of the cable core, such as evacuation, heating or cooling, takes place during the step of making a cable core longitudinally water-tight by means of the method according to the invention. In view of the absence of the elements and sections that would otherwise be required for these purposes, the length of the present apparatus is reduced. Owing to the further absence of sealing elements and of pressure relief chambers, the axial dimensions of the filling head are very compact and the length of the whole apparatus is even further reduced. The maximum effective length of the apparatus is about 2 m. Since the apparatus will form part of a complete line for the manufacture of a cable, a separate driving unit for displacing the cable core is not required because the drive already present suits this purpose.

A preferred embodiment of the arrangement according to the invention is characterized in that the orifices in the separation wall have a profile and dimensions such that the static pressure of the filling material in the orifices is converted substantially completely into dynamic pressure. Experiments have shown that at a speed of about 70 m/sec per jet optimum results are obtained, i.e. a penetration depth as far as the heart of the cable core, even with multi-wire cable cores comprising 2400 pairs or more. The number of bores and their dimensioning are so determined that at the required flow rate of the filling material a maximum build-up of ths static pressure in the pressure chamber upstream of the bores is obtained on the one hand, while on the other hand in the orifices the static pressure is converted into dynamic pressure in a manner such that compact jets without spray effects at the required speed are generated. The number of orifices (four or more) and their diameter (in practice from 1 to 7 mm), have to be mutually adapted.

In another preferred embodiment of the apparatus according to the invention a single series of orifices is provided in the separation wall, as a result of which the axial dimensions of the filling head can be reduced to a minimum, which further contributes to a compact construction of the arrangement.

A further preferred embodiment of the apparatus according to the invention is characterized in that each orifice is located in a separate radial plane. Thus, for example, the orifice may be uniformly distributed helically over the circumference of the separation wall. Due to this measure, with a comparatively small length of the filling head, a good spread of the filling material over a section of the cable core is obtained.

It should be noted that it is known per se from the aforementioned patent specifications to distribute orifices helically over the circumference of a filling die. However, the relevant apparatuses in disclosed these specifications are provided with several series of openings. Such an arrangement has a larger number of components and is more complex. The change-over to another cable type requires a larger number of readjustment operations. Thus the tool per cable type is higher.

Another preferred embodiment of the apparatus according to the invention is characterized by a filling die which, viewed in the direction of transport of the cable core, is arranged behind the filling head. By means of this filling die, the cable core already filled can be subjected to an additional treatment for applying a coating of the filling material to the outer surface of the cable core.

The invention will now be described more fully with reference to the drawings. In the drawings.

Figure 1:
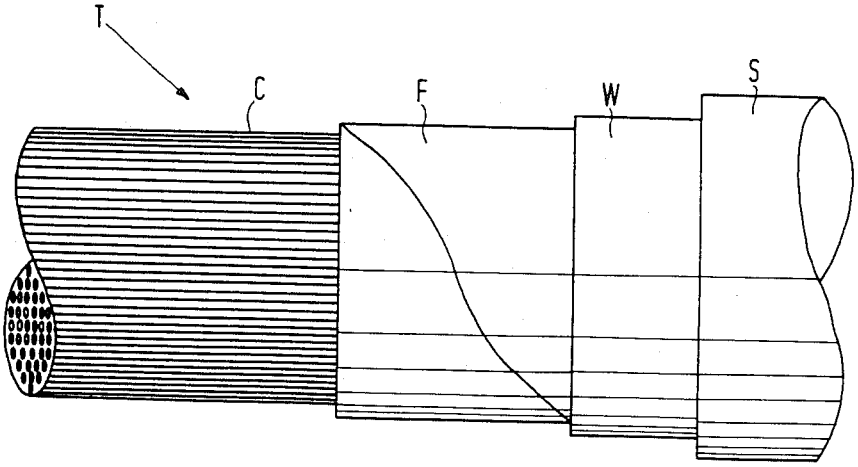
FIG. 1 is a side elevation of an end of a telecommunication cable with a longitudinally water-tight cable core.
Figure 2:
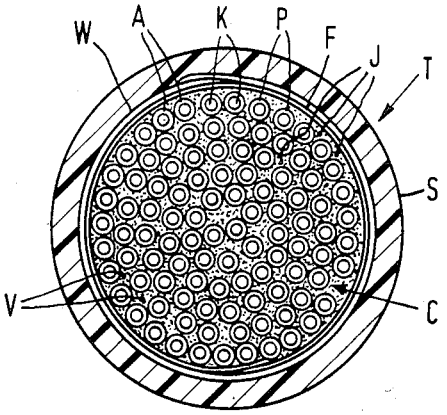
FIG. 2 shows in cross-section the cable shown in FIG. 1.

The embodiment of a telecommunication cable T shown in FIGS. 1 and 2 mainly consists of a cable core C around which is wrapped or folded a foil F, for example of moisture-proof plastics material or the like. A water-proof envelope W surrounds the foil F and this envelope W consists of an aluminum tape provided with a layer of plastics material. Finally a sheath S of plastics material is extruded onto the envelope W.

If such a telecommunication cable has to be laid in the earth, a further armouring (not shown), which generally consists of two wrapped layers of steel tape and an outer sheath of polyethylene, can be provided on the sheath S. The cable core C is composed of single wires A consisting of a copper wire K provided with an insulation sheath P of plastic material, such as polyethylene. The single wires A are stranded in pairs, which are then stranded, if necessary via units, to form the cable core C. During the construction of the cable core, interstices and gaps V are formed between the single wires and the pairs. In order to make the cable core C longitudinally water-tight, these gaps and interstices V are filled with a filling material J having a base of petroleum jelly that may be mixed with polyethylene. This filling material is also applied to the outer circumference of the cable core.

The cable described is only given by way of example. Many alternative different types of cable, which differ both in construction and materials from the cable described above, are well known.

Figure 3:
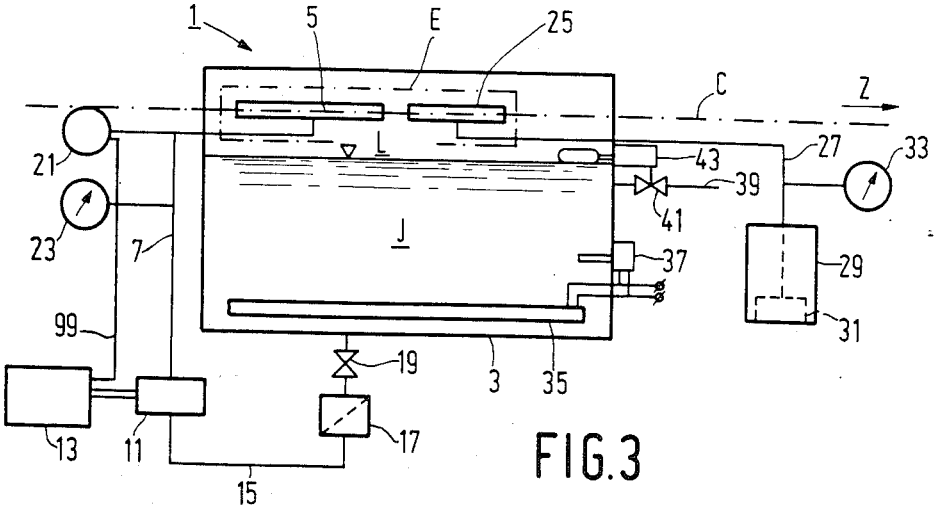
FIG. 3 shows diagrammatically an apparatus for making a cable longitudinally water-tight.

FIG. 3 shows diagrammatically an apparatus 1 for making a cable core C longitudinally water-tight. The arrangement 1 comprises a container 3, in which a stationary filling head 5 is arranged, which is connected through a pressure conduit 7 to a pump 11, which is driven by an electric motor 13. The inlet side of the pump 11 is connected via a suction conduit 15 through a filter 17 and a shut-off valve 19 to the container 3. Between the pump 11 and the filling head 5 there are connected to the pressure conduit 7 a pressure regulator 21 and a pressure gauge 23. Reference numeral 25 designates a tubular filling die, which is connected through a pressure-conduit 27 to a supply vessel 29 with a built-in pump 31. A pressure gauge 33 is connected to the pressure conduit 27. The container 3 accommodates an electrical heating element 35, which serves to heat the jelly-like filling material with which the container 3 is filled up to the level L. The temperature of the filling material in the container 3 can be controlled by means of a thermostat 37, which is connected to the heating element 35. The container 3 is connected to a supply conduit 39, which incorporates a valve 41. The container can be replenished with filling material through the supply conduit 39. If necessary an agitator (not shown) may be arranged in the container 3 in order to obtain a uniform temperature distribution of the filling material in the container. A level regulator 43 ensures that the level L of the filling material J in the container remains substantially constant. C indicates diagrammatically a cable core to be treated, which is displaced in the direction of the arrow Z.

Figure 4:
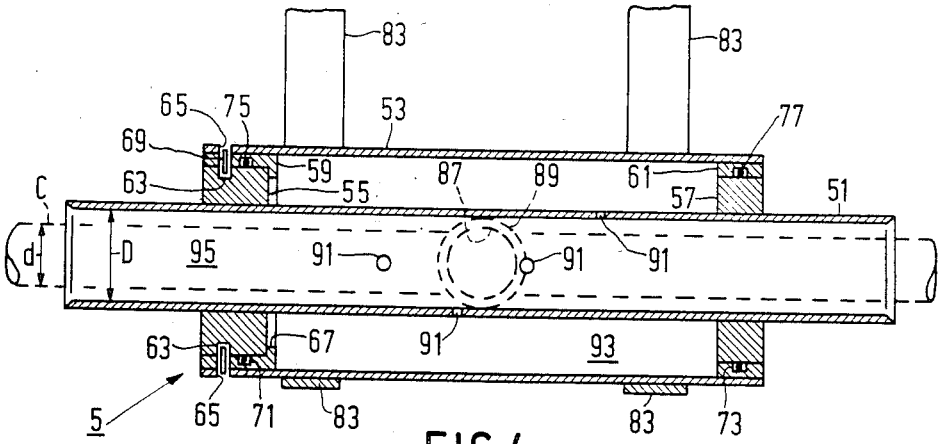
FIG. 4 is a longitudinal sectional view of the filling head of an apparatus according to the invention.

FIG. 4 is a longitudinal sectional view of the filling head 5, which is the essential part of the apparatus and which mainly consists of an inner tube 51 and a sheath tube 53, whose inner diameter is larger than the outer diameter of the inner tube. Two rings 55 and 57 are provided on the outer side of the inner tube, while the sheath tube 53 is provided on its inner side with two bushes 59 and 61. The inner diameter of the bushes 59 and 61 and the outer diameters of the rings 55 and 57 are so dimensioned that the rings fit snugly into the bushes. The ring 55 is provided in its outer side with two diametrically opposed grooves 63 each extending around part of the circumference of the ring, while in the wall of the sheath tube 53 and the bush 59 two diametrically opposed slots 65 are formed, each of which extends around part of the circumference of the sheath tube 53 and the bush 59. In the assembly of the filling head 5, the rings 55 and 57 are inserted into the bushes 59 and 61 until the ring 55 engages a shoulder 67 on the bush 59, with the grooves 63 registering with the slots 65. The inner tube 51 and the sheath tube 53 are locked against relative axial displacement by means of a substantially U-shaped spring chip 69, which is passed through the slots 65 to engage in grooves 63. The bushes 59 and 61 are provided in their inner sides with grooves 71 and 73, respectively, in which sealing rings 75 and 77, respectively, are mounted. On the outer side of the sheath tube 53 there are provided two securing brackets 83, which serve to suspend the filling head 5 in the container 3. The sheath tube 53 is provided with a supply opening 87 to which is connected a pipe 89 which forms part of the pressure conduit 7. In the wall of the inner tube 51 is a number of jet orifices 91 (four in the embodiment shown) which are located in separate radial planes and are spaced about the axis of the tube. The annular space 93 between the inner tube 51 and the sheath tube 53 is in communication via the supply opening 87, the pipe 89 and the pressure conduit 7 with the pump 11 and acts as a pressure chamber. Via the orifices 91, this pressure chamber is in communication with the space inside the inner tube 51 and this space acts as a passage chamber 95. The passage chamber 95 extends without any restriction from one end to the other end of the inner tube 51. A cable core C to be treated can pass through the passage chamber 95 with a large amount of radial clearance because the diameter d of the cable core is smaller than the inner diameter D of the inner tube 51 and, because these are no sealing members, such as sleeves, dies and the like, the passage chamber 95 is substantially without pressure during the step of filling the cable core.

Figure 5:
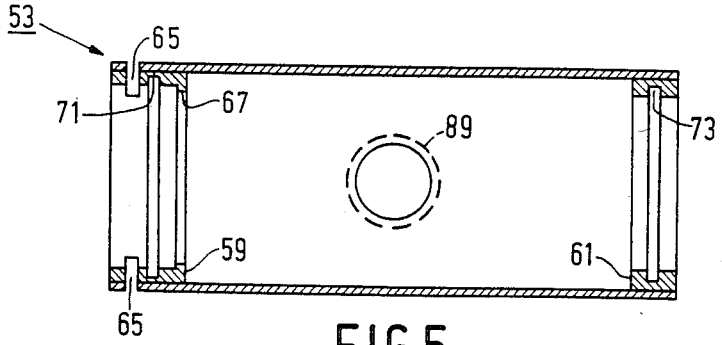
FIGS. 5 and 6 show parts of the filling head in longitudinal sectional view.
Figure 6:
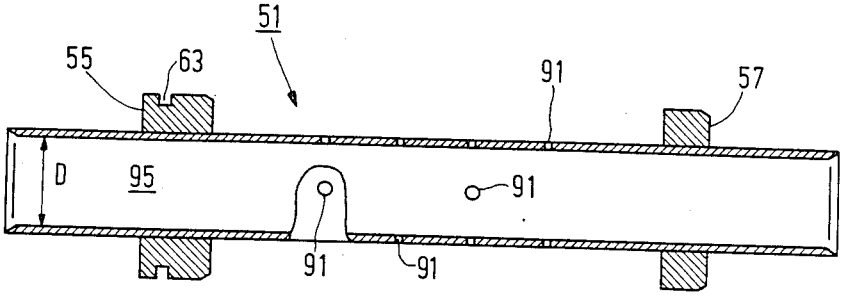

FIGS. 5 and 6 show the sheath tube 53 and the inner tube 51 separately in longitudinal sectional view. These two figures clearly illustrate the simple construction of the filling head, which does not comprise parts susceptible to wear. The same inner tube is suitable for the treatment of a series of cable cores having different diameters. If the cable cores to be treated have a diameter larger than the inner diameter D of the inner tube 51 an inner tube 51 having a larger diameter D and, if necessary, a larger number of orifices 91, which is fitted in the sheath tube 53, and this larger inner tube can in turn be used for filling a further series of different cable cores. Thus, with a very limited number of component parts, the complete series of all cable types available can be treated.

Figure 7:
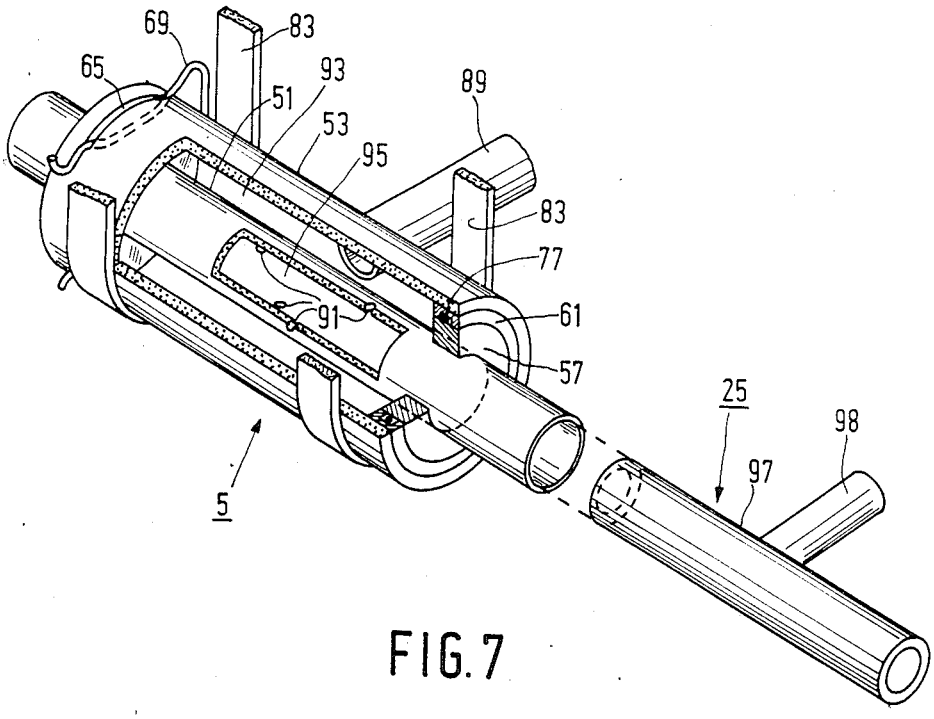
FIG. 7 is an exploded view of the filling head partly cut away.

FIG. 7 is an exploded perspective view of the part framed by the broken-line rectangle E in FIG. 1, which part comprises the filling head 5 and the filling die 25. The filling head 5 has already been fully described with reference to FIGS. 4, 5 and 6. The filling die 25 mainly consists of a tube 97 which is connected to a supply pipe 98, which forms part of the pressure conduit 28 leading from the supply vessel 29. By means of the filling die 25, a coating layer is applied to the outer surface of the cable core already filled. The filling material supplied to the filling die 25 has a lower temperature than the filling material to be injected, i.e. a temperature below the drop point. The inner diameter of the tube 97 should be such that the cable core to be treated can pass through the filling die with a certain amount of clearance. The filling material is supplied in an excess quantity, the excess filling material supplied flowing back in the axial direction into the container 3.

The method of filling the cable core of a telecommunication cable according to the invention will now be described in greater detail in the following example. The apparatus 1 is generally positioned in front of a folding station or lapping head (not shown) for wrapping the foil F around the filled cable core. If permitted by the space available, the apparatus 1 can be integrated into a production line and can be positioned directly behind a stranding station. The cable to be treated is transported through the apparatus by means of a drive already present behind the folding station or lapping head, which may be a capstan, a cater-pillar, a take-up reel or the like.

The container 3 is filled with filling material J up to the level L, which is maintained by the level regulator 43. By switching on the heating element 35, the filling material J is heated to a temperature above the drop point. The required temperature is adjusted and maintained by means of the temperature regulator 37. The pressure regulator 21 is adjusted to a given pressure required for the cable core to be treated. Meanwhile, the cable core to be treated is passed through the apparatus 1, is threaded through the filling head 5 and the filling die 25 and is introduced into the folding station or lapping head positioned behind it. When the adjusted temperature has been reached, the pumps 11 and 31 are switched on. The cable core C is drawn through the apparatus 1 and in the manner described above is filled with the filling material J in a continuous processing step during its passage through the filling head 5 in the manner described above and is provided with a layer of filling material during the passage through the filling die 25. The constructional details of the filling head 5 have already been fully described above. The filling material is metered by means of pressure regulation. For this purpose, the predetermined pressure to which the pressure regulator 21 is adjusted is maintained by regulation of the speed of the electric motor 13, which serves to drive the pump 11, via the feedback connection 99. The shut-off valve 19 acts as a service valve and serves to shut-off the suction conduit 15 during cleaning of the filter 17.

By means of the apparatus described, a cable core having the dimensions mentioned below was made longitudinally water-tight, the following parameters being used:

outer diameter d of the cable core C: 61 mm,
number of single wires: 1808,
wire diameter: 1.04 mm,
inner diameter D of inner tube 51: 65 mm,
number of orifices 91: 4,
diameter of orifices 91: 3.5 mm,
inner diameter of die tube 97: 65 mm,
filling material: petroleum jelly,
drop point $T_d$: 75° C.,
adjusted pressure of pressure regulator 21: 1500 kPa,
flow rate of main pump 11: 2.3 $dm^3$/sec,
flow rate of pump 31: 0.2 $dm^3$/sec, speed of injection of jets: 52 m/sec,
speed of transport of cable core C: 5 m/min.

By means of the same filling head, other cables whose parameters do not differ too greatly from the example described, if necessary with a modification of pressure and speed of transport, (can be made longitudinally water-tight.) The filling die 25 may have to be replaced, if necessary, by another filling die adapted to the cable diameter. For the treatment of cable cores having more widely deviating diameters, only the inner tube 51 has to be replaced. That other inner tube is then again suitable for the treatment of cable cores within a given range of diameters.

What is claimed is:

1. A method of making the cable core of a telecommunication cable water-tight in the longitudinal direction, in which the cable core consisting of stranded single wires is passed through a filling head, a filling material mainly consisting of hydrocarbons is supplied under pressure and in an excess quantity to the filling head at a temperature above the pour point of the material, is spread over the circumference of the cable core and is introduced into the cable core and the excess filling material not absorbed by the cable core is drained away, characterized in that the filling material is divided into a number of separate jets distributed over the circumference of the cable core so that a substantially complete conversion of the static pressure into dynamic pressure is obtained and the filling material is injected at a high speed, solely in purely radial directions and without generation of an axial speed component, through the outer layer of the cable core at least into the heart of the cable core in a manner such that a reconversion of the dynamic pressure into static pressure is effected in the cable core.

2. A method as claimed in claim 1, characterized in that the steps of converting the static pressure into dynamic pressure and of dividing the filling material into a number of jets take place in the filling head.

3. A method as claimed in claim 1, characterized in that the filling material is divided into a single series of jets.

4. A method as claimed in claim 1, characterized in that the separate jets are offset relative to one another, viewed in the longitudinal direction of the cable core.

5. A method as claimed in claim 1, characterized in that in a further additional processing step filling material is applied to the outer surface of the cable core at a lower temperature below the drop point and in an excess quantity.

6. An apparatus for carrying out the method claimed in claim 1, comprising a container for filling material, a filling head, a pump for the supply of filling material from said container to the filling head and heating means for heating the filling material, the filling head comprising an annular pressure chamber and a central passage coaxial with said pressure chamber through which said cable core is transported, the pressure chamber being connected to the pump and being in communication with the passage chamber through a series of orifices in a separation wall, characterized in that the passage chamber extends without any restriction from one end to the other end of the filling head, is provided with two ends both of which are open and is in free communication with the immediate surroundings.

7. An apparatus as claimed in claim 6, characterized in that the orifices in the separation wall have a profile and dimensions such that the static pressure of the filling material in the orifices is converted substantially completely into dynamic pressure.

8. An apparatus as claimed in claim 6, characterized in that a single series of orifices is provided in the separation wall.

9. An apparatus as claimed in claim 6, characterized in that each orifice is located in a separate radial plane.

10. An apparatus as claimed in claim 6, characterized by a filling die which, viewed in the direction of transport of the cable core, is arranged behind the filling head.

* * * * *